US009224331B2

(12) United States Patent
Kretz et al.

(10) Patent No.: US 9,224,331 B2
(45) Date of Patent: Dec. 29, 2015

(54) ORGANIC ELECTROLUMINESCENT DISPLAY

(75) Inventors: Thierry Kretz, Saint Jean de Moirans (FR); Hugues Lebrun, Coublevie (FR); Elisabeth Chuiton, Revel (FR)

(73) Assignee: THOMSON Licensing S.A.S., Issy les Moulineaux (FR)

( * ) Notice: Subject to any disclaimer, the term of this patent is extended or adjusted under 35 U.S.C. 154(b) by 970 days.

(21) Appl. No.: 12/298,140

(22) PCT Filed: Apr. 27, 2007

(86) PCT No.: PCT/EP2007/054148

§ 371 (c)(1),
(2), (4) Date: Oct. 23, 2008

(87) PCT Pub. No.: WO2007/125095

PCT Pub. Date: Nov. 8, 2007

(65) Prior Publication Data

US 2009/0096725 A1 Apr. 16, 2009

(30) Foreign Application Priority Data

Apr. 28, 2006 (FR) ..... 06 03863

(51) Int. Cl.
*G09G 3/32* (2006.01)

(52) U.S. Cl.
CPC ..... *G09G 3/3233* (2013.01); *G09G 2300/0417* (2013.01); *G09G 2300/0439* (2013.01);
(Continued)

(58) Field of Classification Search
CPC ..... G09G 2310/0202; G09G 2310/0213
USPC ..... 345/76–83, 204–215, 690–699; 315/169.1–169.4
See application file for complete search history.

(56) References Cited

U.S. PATENT DOCUMENTS 5,233,338 A * 8/1993 Surguy ..... 345/88
6,359,608 B1 3/2002 Lebrun et al.
(Continued)

FOREIGN PATENT DOCUMENTS

CN 1475983 A 2/2004
CN 1655036 A 8/2005
(Continued)

OTHER PUBLICATIONS

You, B-H, et al., "P-14: Polarity-Balanced Driving to Reduce Vth Shift in a-Si for Active-Matrix OLEDs", SID 04 Digest, vol. 35, pp. 272-275, (2004).
(Continued)

*Primary Examiner* — Patrick F Marinelli
(74) *Attorney, Agent, or Firm* — Oblon, McClelland, Maier & Neustadt, L.L.P.

(57) ABSTRACT

An organic light-emitting display screen includes n×m picture dots organized in a matrix with m rows and n columns. Each picture dot includes an organic diode and first and second driver circuits for the diode. Each of the first and second driver circuits includes a driving transistor connected between a reference voltage and one electrode of the diode, a switching transistor for switching a gate voltage onto a gate of the driving transistor, and a capacitor connected to the gate of the driving transistor. A circuit for addressing each of the n×m picture dots, to control alternately and simultaneously a recovery phase on one driver circuit and a display phase on the other driver circuit of a picture dot, includes as row select lines, only m row select lines, one per row of picture dots, and/or as data lines, only n data lines, one per column of picture dots.

9 Claims, 10 Drawing Sheets

(52) U.S. Cl.
CPC ..... *G09G2300/0823* (2013.01); *G09G 2300/0852* (2013.01); *G09G 2310/0254* (2013.01); *G09G 2320/0233* (2013.01); *G09G 2320/043* (2013.01)

(56) References Cited

U.S. PATENT DOCUMENTS

| | | | | |
|---|---|---|---|---|
| 6,548,960 | B2 | 4/2003 | Inukai | |
| 6,636,206 | B1 | 10/2003 | Yatabe | |
| 7,557,780 | B2 * | 7/2009 | Kimura | 345/76 |
| 7,589,698 | B2 * | 9/2009 | Osame et al. | 345/76 |
| 8,144,101 | B2 | 3/2012 | Lebrun | |
| 2002/0000576 | A1 * | 1/2002 | Inukai | 257/202 |
| 2004/0004443 | A1 * | 1/2004 | Park et al. | 315/169.1 |
| 2004/0066146 | A1 * | 4/2004 | Park et al. | 315/169.3 |
| 2005/0110723 | A1 * | 5/2005 | Shin | 345/76 |
| 2006/0038757 | A1 * | 2/2006 | Lee et al. | 345/77 |
| 2006/0097965 | A1 * | 5/2006 | Deane et al. | 345/76 |
| 2006/0125741 | A1 * | 6/2006 | Tanaka et al. | 345/79 |
| 2006/0244705 | A1 * | 11/2006 | Song et al. | 345/98 |
| 2007/0035483 | A1 * | 2/2007 | Chang | 345/76 |
| 2007/0152923 | A1 * | 7/2007 | Baik et al. | 345/76 |
| 2008/0180364 | A1 * | 7/2008 | Kim | 345/76 |
| 2008/0231556 | A1 * | 9/2008 | Kretz et al. | 345/76 |
| 2009/0179875 | A1 * | 7/2009 | Li et al. | 345/204 |
| 2009/0256833 | A1 * | 10/2009 | Huang et al. | 345/213 |
| 2011/0298779 | A1 * | 12/2011 | Chen et al. | 345/212 |

FOREIGN PATENT DOCUMENTS

| | | | |
|---|---|---|---|
| EP | 0815552 | | 1/1998 |
| FR | 2 873 227 | | 1/2006 |
| JP | 2001147670 | | 5/2001 |
| JP | 2001242827 | | 9/2001 |
| JP | 2004-94211 | | 3/2004 |
| JP | 2005135035 | | 5/2005 |
| JP | 2005-222024 | | 8/2005 |
| JP | 2005-275370 | | 10/2005 |
| JP | 2005-331941 | | 12/2005 |
| JP | 2006-163045 | | 6/2006 |
| JP | 2007-519949 | | 7/2007 |
| TW | 200424995 | A | 11/2004 |
| TW | 200601221 | A | 1/2006 |
| WO | WO2006005749 | | 1/2006 |

OTHER PUBLICATIONS

Office Action issued Apr. 24, 2012 in Japanese Application No. 2009-507086 (English Translation).

Search Report issued May 10, 2013 in Taiwanese Patent Application No. 096115388.

Office Action issued in Japanese Patent Application No. 2012-185434 on Dec. 17, 2013 with partial English translation.

Decision to Grant from Korean Intellectual Property Office with English translation, dated Jul. 30, 2013, 3 pages.

Japanese Office Action issued in JP Patent Application No. 2009-507086, dated Apr. 24, 2012 in English language, 4 pages.

* cited by examiner

Background Art

| Frame(k) | $D_j$ | $D_j'$ | $D_{j+1}$ | $D_{j+1}'$ |
|---|---|---|---|---|
| $S_{i-1}$ | Vv | Vb | Vv | Vb |
| $S_i$ | Vv | Vb | Vv | Vb |
| $S_{i+1}$ | Vv | Vb | Vv | Vb |
| Frame(k+1) | | | | |
| $S_{i-1}$ | Vb | Vv | Vb | Vv |
| $S_i$ | Vb | Vv | Vb | Vv |
| $S_{i+1}$ | Vb | Vv | Vb | Vv |

| Frame(k) scan from i=0 à m | $D_j$ | $D_j'$ | $D_{j+1}$ | $D_{j+1}'$ |
|---|---|---|---|---|
| $S_{i-1}$ | Vv | Vb | Vv | Vb |
| $S_i$ | Vv | Vb | Vv | Vb |
| $S_{i+1}$ | Vv | Vb | Vv | Vb |
| Frame(k+1) scan from i= m à 0 | | | | |
| $S_{i+1}$ | Vb | Vv | Vb | Vv |
| $S_i$ | Vb | Vv | Vb | Vv |
| $S_{i-1}$ | Vb | Vv | Vb | Vv |

Duration of a frame with scanning of the m select lines $S_i$, i=1 a m

| Top to bottom scan frame k | Start of frame | | Middle of frame | | End of frame | |
|---|---|---|---|---|---|---|
| | Di | Di' | Di | Di' | Di | Di' |
| $S_1$ | Vv (k) | Vb (k) | Vv (k) | Vb (k) | Vv (k) | Vb (k) |
| $S_{m/2}$ | Vb (k-1) | Vv (k-1) | Vv (k) | Vb (k) | Vv (k) | Vb (k) |
| $S_m$ | Vb (k-1) | Vv (k-1) | Vb (k-1) | Vv (k-1) | Vv (k) | Vb (k) |

| Top to bottom scan frame k+1 | Start of frame | | Middle of frame | | End of frame | |
|---|---|---|---|---|---|---|
| | Di | Di' | Di | Di' | Di | Di' |
| $S_1$ | Vb (k+1) | Vv (k+1) | Vb (k+1) | Vv (k+1) | Vb (k+1) | Vv (k+1) |
| $S_{m/2}$ | Vv (k) | Vb (k) | Vb (k+1) | Vv (k+1) | Vb (k+1) | Vv (k+1) |
| $S_m$ | Vv (k) | Vb (k) | Vv (k) | Vb (k) | Vb (k+1) | Vv (k+1) |

| Bottom to top scan frame k+2 | Start of frame | | Middle of frame | | End of frame | |
|---|---|---|---|---|---|---|
| | Di | Di' | Di | Di' | Di | Di' |
| $S_1$ | Vb (k+1) | Vv (k+1) | Vb (k+1) | Vv (k+1) | Vv (k+2) | Vb (k+2) |
| $S_{m/2}$ | Vb (k+1) | Vv (k+1) | Vv (k+2) | Vb (k+2) | Vv (k+2) | Vb (k+2) |
| $S_m$ | Vv (k+2) | Vb (k+2) | Vv (k+2) | Vb (k+2) | Vv (k+2) | Vb (k+2) |

| Bottom to top scan frame k+3 | Start of frame | | Middle of frame | | End of frame | |
|---|---|---|---|---|---|---|
| | Di | Di' | Di | Di' | Di | Di' |
| $S_1$ | Vv (k+2) | Vb (k+2) | Vv (k+2) | Vb (k+2) | Vb (k+3) | Vv (k+3) |
| $S_{m/2}$ | Vv (k+2) | Vb (k+2) | Vb (k+3) | Vv (k+3) | Vb (k+3) | Vv (k+3) |
| $S_m$ | Vb (k+3) | Vv (k+3) | Vb (k+3) | Vv (k+3) | Vb (k+3) | Vv (k+3) |

FIG.8b

| Addressing according to a row-swap type mode | | |
|---|---|---|
| Frame k | Di | Dj |
| $S_i$ (T2) | Vv | Vv |
| $S_{i'}$ (T2') | Vb | Vb |
| $S_{i+1}$ (T2) | Vv | Vv |
| $S_{i'+1}$ (T2') | Vb | Vb |
| | | |
| Frame k+1 | Di | Dj |
| $S_i$ (T2) | Vb | Vb |
| $S_{i'}$ (T2') | Vv | Vv |
| $S_{i+1}$ (T2) | Vb | Vb |
| $S_{i'+1}$ (T2') | Vv | Vv |

FIG.10

ORGANIC ELECTROLUMINESCENT DISPLAY

BACKGROUND OF THE INVENTION

1. Field of the Invention

The present invention relates to an organic light-emitting display screen and more particularly to an organic light-emitting display screen of the active matrix type, or AMOLED (Active Matrix Organic Light Emitting Diode).

In an organic light-emitting display screen, the picture element (pixel) is an organic light-emitting diode structure. Such a display screen does not require any additional light source, in contrast to other display devices such as the devices referred to as LCDs (Liquid Crystal Displays). Its other advantages include a low power consumption, a high brightness and low fabrication costs. The display of video data by OLED diodes is based on the principle of the modulation of the diode current. This is achieved by a current-driver transistor, which receives a voltage on its gate corresponding to the video data to be displayed and supplies a corresponding current to the diode.

2. Discussion of the Background

In FIG. 1 is shown an equivalent circuit diagram of an OLED picture dot or pixel according to the prior art. As illustrated in this Figure, the device usually comprises a crossed array of select lines $S_1, S_2, \ldots S_m$, and data lines $D_1, D_2, \ldots D_n$, m and n being integer numbers. To each pixel $Pix_{i,j}$ of the matrix corresponds one select line $S_i$, $i \in [1, \ldots m]$, and one data line $D_j$, $j \in [1, \ldots n]$, by which this pixel is controlled. Each pixel $Pix_{i,j}$ comprises an organic light-emitting diode or OLED and an associated current-driver circuit. This circuit comprises a switching transistor T1, a holding capacitor C1 and a current control, or "driving", transistor T2. A gate electrode of the switching transistor T1 is connected to the corresponding select line $S_i$ and a conduction electrode, source or drain, connected to the associated data line $D_j$. The other conduction electrode is connected to one terminal of the holding capacitor C1, and to the gate electrode of the driving transistor T2. The holding capacitor C1 has its other terminal connected to a reference voltage VDD. The driving transistor is connected in series with the organic light-emitting diode OLED between the reference voltage and ground: the anode of the diode is thus connected to a conduction electrode (drain or source) of the transistor T2 and its cathode is connected to a potential VK common to all the diodes of the display screen, typically the electrical ground. In the example, the transistors T1 and T2 are n-type.

In the usual manner, at each new video frame, the rows of pixels are selected in sequence by the application to their respective select line $S_1, S_2, \ldots S_m$, of a selection voltage Vgon, lasting for a row time. The video data signals corresponding to a selected row of pixels are applied to the data lines $D_1, \ldots D_j$. These selection and data lines are controlled by respective driver circuits, called row driver and column driver, which may be integrated into the matrix or external to it. These circuits are well known to those skilled in the art.

The picture element $Pix_{i,j}$ is now considered. When the select line $S_i$ is addressed, the switching transistor T1 turns on for the addressing time (row time) of the line. It switches the video voltage present on the data line $D_j$ onto the gate of the driving transistor T2. The transistor T1 then turns off and isolates the pixel from the data line. The capacitor C1 then ensures that the voltage on the gate of the transistor T2 is maintained. The transistor T2 operates as a controlled current source: it supplies to the OLED diode a current whose intensity depends on the video voltage switched onto its gate. The OLED diode emits a corresponding intensity of light. In this operation, the transistor T2 is continuously supplied with power: the duty cycle for the application of this voltage is therefore 100% for each video frame. The diode is also continuously driven, with a duty cycle of 100%.

The intensity of the current flowing in the driving transistor T2 depends on the level of the voltage switched onto the gate of the transistor T2. It also depends on the threshold voltage of this transistor. It is recalled that the threshold voltage of a transistor represents the minimum potential difference that must be applied between the gate and source of the transistor so that the latter allows current to flow: below this, the transistor is said to be turned off. The higher the potential difference, the more current the transistor allows to flow, until it becomes saturated. The drain-source current Ids is given by the following general equation: $Ids=K(V_{gs}-V_{th})^2$, where $V_{th}$ is the threshold voltage and $V_{gs}$ the gate-source voltage.

In order to have a sufficient luminance and a good uniformity of the display screen, the current Ids corresponding to a given grey level must be constant over time whichever pixel of the display screen is considered.

The invention relates more particularly to AMOLED display screens, whose transistors of the active matrix (the transistors T1 and T2 of the pixels $Pix_{i,j}$) are thin-film transistors, referred to as TFTs, and notably to AMOLED display screens using an active matrix with amorphous silicon TFT transistors, which matrices are advantageously inexpensive. In these display screens, a significant positive drift of the threshold voltage of the driving transistor T2 is observed with the level of the voltage applied continuously to its gate (duty cycle of 100%). More generally, the threshold voltage of these transistors varies with temperature, the gate-source voltage applied to it and the duty cycle, in other words the time during which the voltage Vgs is applied with respect to the frame time. This also applies to other types of transistors, for example transistors using materials between amorphous silicon and polycrystalline silicon.

FIG. 2 illustrates a typical curve 1 of the drain-source current Ids as a function of the gate-source voltage Vgs of an amorphous silicon TFT transistor, under initial conditions, with a threshold voltage $Vth_0$. In the example, the transistor is an n-type transistor. Such a transistor has a positive or zero threshold voltage. It is made to conduct by applying a positive gate-source voltage, higher than its threshold voltage. After the transistor has been subjected to a positive stress SP, in other words to a gate-source voltage higher than the threshold voltage of the transistor, during one frame time (typically 20 milliseconds), a second curve 2 is obtained, which corresponds to a translation of the initial curve in the direction of increasing Vgs. This means that, owing to the positive stress, the threshold voltage of the transistor has increased, going from $Vth_0$ to $Vth_1 > Vth_0$. The effect of this is that, for the same gate-source voltage, a lower current Ids will be driven in the transistor, and therefore the OLED diode will emit less light.

For a given data value to be displayed, the level of light obtained is therefore variable according to the effective threshold voltage of the transistor, at the time of observation. Since the threshold voltage has a positive drift, the current delivered by the driving transistors decreases, which results in a loss of luminance on AMOLED display screens.

Since the video voltages to be displayed vary from one pixel to another, this variation of the threshold voltage of the driving transistors T2 furthermore results in a significant non-uniformity over the AMOLED display screen.

SUMMARY OF THE INVENTION

One object of the invention is to solve this problem of degradation of the display on AMOLED display screens due to the drift of the threshold voltage of the driving transistors that control the organic light-emitting diodes.

One object of the invention is to provide a structure at minimal cost in terms of addressing control circuits.

One solution to this technical problem has been found in the invention which consists principally in providing a recovery phase for the drift of the threshold voltage of the driving transistor of each pixel. During this recovery phase, the driving transistor is turned off, by an appropriate value of voltage applied to its gate. The transistor is then subjected to a reverse stress to that it was subjected to during the display period, in such a manner that the threshold voltage returns to around its initial value $Vth_0$. Since the diode must be driven with a duty cycle of 100%, a first and a second driving transistor per diode are therefore provided, which are controlled in the appropriate manner such that, while one drives the current in the diode, the other is turned off, and vice versa. On average, for each transistor, the drift of the threshold voltage is zero.

The invention therefore relates to an organic light-emitting display screen comprising a crossed array of select lines and data lines in order to display successive video frame data on a plurality of picture dots by means of respective select and data lines, characterized in that each picture dot comprises an organic diode and first and second driver circuits for the said diode, each driver circuit comprising:

a driving transistor connected between a reference voltage and one electrode of the said diode, a switching transistor for switching a gate voltage onto the gate of the said driving transistor, a capacitor connected to the gate of the said driving transistor, in order to maintain the said gate voltage, in that the said gate voltage of a driving transistor is alternately a video voltage, controlling a display phase, or a turn-off voltage, controlling a recovery phase, and in that the driving transistors are alternately controlled, one in recovery phase, the other in display phase, and vice versa.

The control of these circuits is optimized in such a manner that, in a matrix with n.m picture dots organized according to m rows and n columns, it uses as row select lines the only m row select lines of the matrix and/or as data lines the only n data lines of the matrix.

The turn-off voltage is preferably a function of the video voltage.

The invention also relates to a control circuit in a light-emitting display screen comprising: an organic diode and first and second driver circuits for the said diode, each driver circuit comprising:

a driving transistor connected between a reference voltage and one electrode of the said diode, a switching transistor for switching a gate voltage onto the gate of the said driving transistor, a capacitor connected to the gate of the said driving transistor, in order to maintain the said gate voltage, and means for controlling the said first and second circuits, so as to apply, as gate voltage, a video voltage to one and a turn-off voltage to the other.

In one variant, each of the said first and second driver circuits comprises another switching transistor connected between the gate of the switching transistor and the gate of the driving transistor.

The invention relates to several embodiments of the control of these driver circuits, using the select lines and/or data lines of the display screen.

Advantageously, use is made of the row drivers that control the select lines and/or the column drivers that control the data lines in liquid crystal display (LCD) screens in order to control these circuits in a suitable manner.

Other advantages and features of the invention are detailed in the following description with reference to the illustrated drawings of embodiments of the invention, presented by way of non-limiting example. In these drawings:

Still other objects and advantages of the present invention will become readily apparent to those skilled in the art from the following detailed description, wherein the preferred embodiments of the invention are shown and described simply by way of illustration of the best mode contemplated of carrying out the invention. As will be realized, the invention is capable of other and different embodiments, and its several details are capable of modifications in various obvious aspects, all without departing from the invention.

Accordingly, the drawings and description thereof are to be regarded as illustrative in nature, and not as restrictive.

FIG. 1, already described above, illustrates the structure of an OLED diode picture element according to the prior art;

FIGS. 7, 8*a* and 8*b* illustrate a corresponding addressing mode and addressing sequences;

FIG. 10 illustrates a corresponding addressing mode;

DESCRIPTION OF THE PREFERRED EMBODIMENTS

Figure 1:
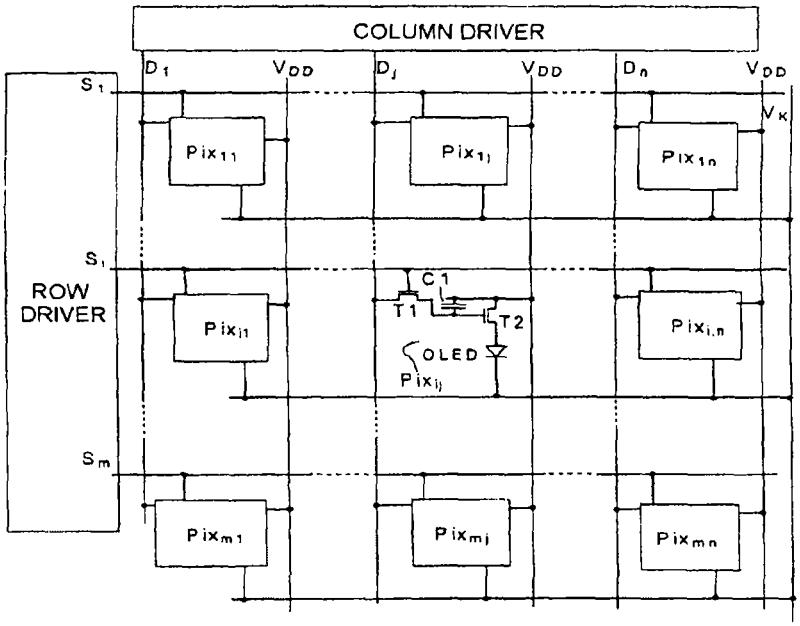
Figure 2:
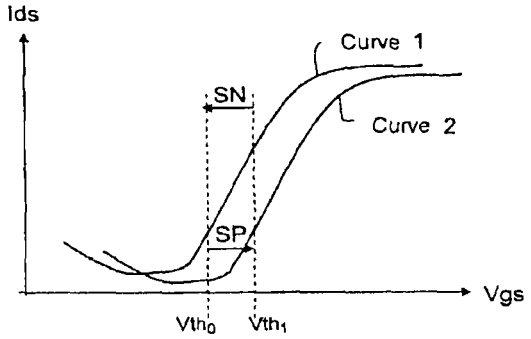
Background Art FIG.2
FIG. 2 illustrates the known phenomenon of drift of the threshold voltage of a transistor.

For the sake of clarity and simplicity of the description, the elements that are common to the various figures carry the same references. In the figures, the voltages applied to the gates of the transistors T2 and T2' are denoted Vg(T2) and Vg(T2').

According to the invention and as illustrated in FIGS. 3, 6, 9 and 11, each picture dot (or element) $Pix_{i,j}$ of the organic light-emitting display screen comprises two driver circuits COM and COM', of identical structure, associated with the organic light-emitting diode OLED of this dot $Pix_{i,j}$. The OLED diode comprises a first electrode E1 via which it is current driven, and a second electrode E2 (cathode) connected to a potential VK common to all the diodes of the screen. In the following, it is considered that this potential is electrical ground and is represented by a corresponding symbol.

The two driver circuits COM and COM' are each connected at their outputs to the electrode E1 of the OLED diode. They have an identical structure. They each comprise a switching transistor, a driving transistor and a holding capacitor. By convention, these elements of the first circuit referenced COM are denoted as T1, C1 and T2, and these elements of the second circuit referenced COM' as T1', C1' and T2'.

According to the invention, these circuits COM and COM' are controlled by select and/or data lines of the matrix in such a manner that they have a different function at each video frame, these functions being reversed periodically. These functions are: 1.—display video information, by application of a video voltage to the gate of the driving transistor, in order to deliver a corresponding current to the OLED diode and 2.—compensate for the stress caused by the first function, by recovery phases during which a turn-off voltage is applied to the gate of the driving transistor.

Thus, during a given video frame, one of the two circuits, for example the circuit COM, has the function of displaying the video information via the OLED diode, by applying a corresponding video voltage to the gate of its transistor T2, whereas the other circuit, in the example COM', has the function of applying a turn-off voltage to the gate of its transistor T2', which puts this transistor into the phase for recovery of the drift in threshold voltage, according to the invention. The functions of the two circuits are reversed periodically: the circuit COM' then has the function of displaying the video information, by applying a corresponding video voltage to its transistor T2', whereas the circuit COM has the function of compensating for the stress undergone by its transistor T2, by applying a turn-off voltage to it.

Since, on average, one out of every two frames is used for each driver circuit in order to de-stress its driving transistor, the average drift of the threshold voltage of each driving transistor of the active matrix is zero or approximately so. This can be achieved without affecting the duty cycle for the application of the video voltage to the OLED diode, so that the diode remains continuously driven (duty cycle of 100%).

The reversing period of the functions of the driver circuits is preferably the frame period: at each new video frame, the functions of the circuits are reversed. More generally, a reversing of the functions may be envisaged every K frames, K being any integer number. It will be seen that a corresponding addressing mode of the circuits COM and COM' may be easily implemented by using commercially available row and column drivers.

The turn-off voltage of the recovery phase can be a predetermined fixed voltage. It is advantageously variable. For each picture dot, it is advantageously a function of the video voltage applied to the picture dot. Indeed, the video voltage applied varies from one picture element of the display screen to another. For a given pixel, the video voltage also varies with time, from one frame to another. The drift of the threshold voltages is therefore variable from one pixel to another. For this reason, by fixing the turn-off voltage, an image with a non-uniform luminance is obtained, in spite of the recovery phase. By advantageously arranging for the turn-off voltage to be such that it applies a stress amplitude to the driving transistor that is the inverse of the video voltage, an intelligent recovery of the drift of the threshold voltage is implemented.

Figure 3:
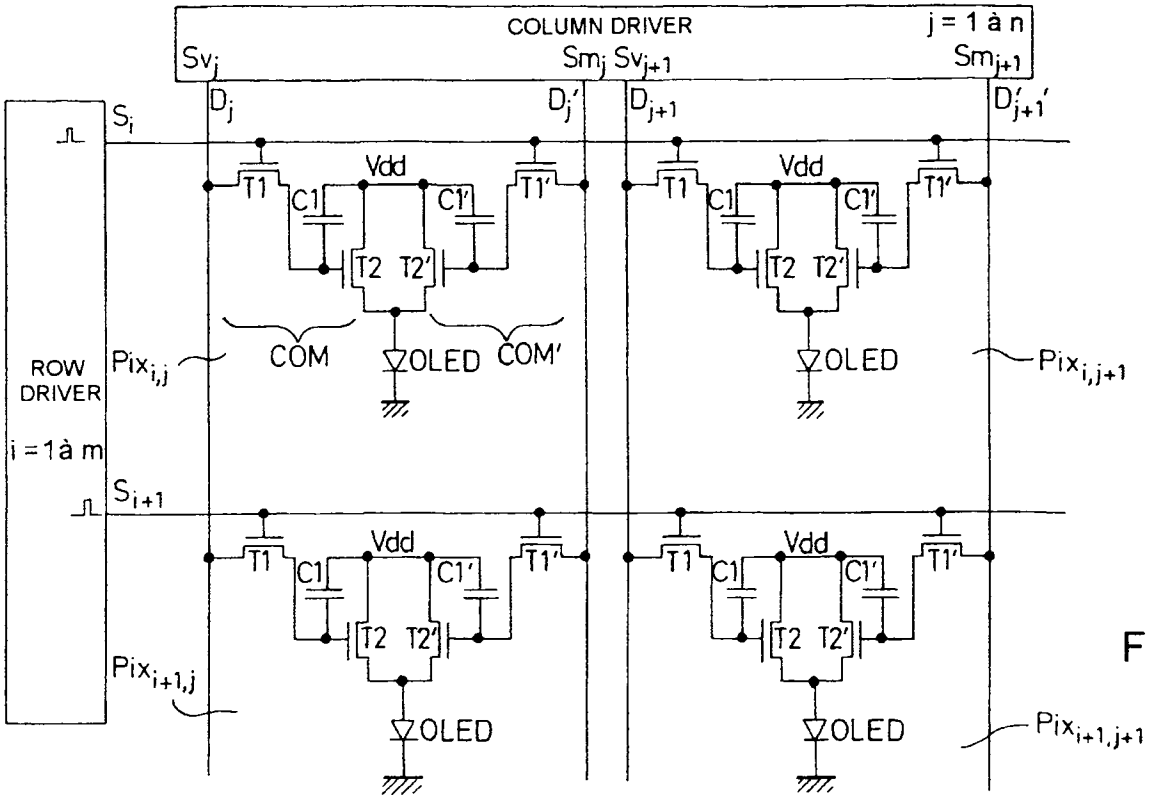
FIG. 3 illustrates an OLED diode picture element structure according to a first embodiment of the invention.

The embodiment according to the invention illustrated in FIG. 3 is now considered. The display screen comprises n.m pixels $Pix_{i,j}$, i=1 to m; j=1 to n. It comprises m select lines $S_i$, each line allowing n pixels of the display screen to be addressed. It comprises 2.n data lines $D_j$ and $D_j'$, which allow a video voltage and a turn-off voltage to be applied to each of the n pixels of one select line.

More precisely, to each picture element $Pix_{i,j}$ corresponds one select line $S_i$ to which are connected the gates of the switching transistors T1 and T1', a first data line $D_j$ and a second data line $D_j'$. The first data line $D_j$ is connected to the switching transistor of one of the driver circuits, and the second data line $D_j'$ is connected to the switching transistor of the other driver circuit. Thus, in the example, $D_j$ is connected to the switching transistor T1 of the circuit COM and $D_j'$ is connected to the switching transistor T1' of the circuit COM'.

Figures 4, 5:
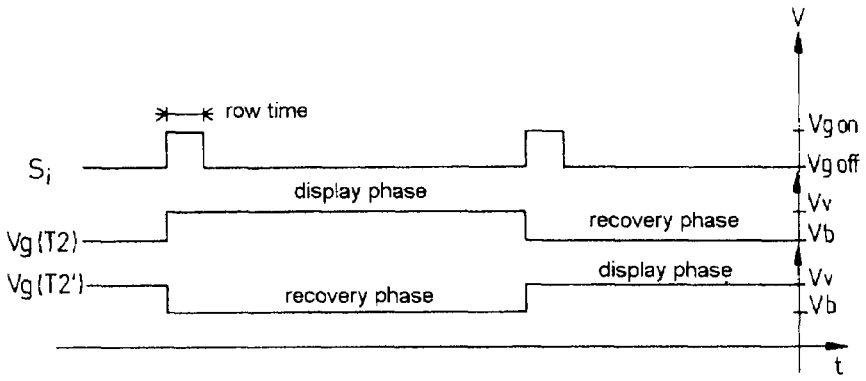
FIGS. 4 and 5 illustrate a corresponding addressing mode and addressing sequence.

As illustrated in FIG. 4, during a given video frame k, the data line $D_j$ will deliver the video voltage Vv and the data line $D_j'$ will deliver the turn-off voltage Vb. It is the driving transistor T2 that will then deliver the current to the OLED diode, whereas the transistor T2' will be in the recovery phase.

During another video frame, for example the following frame k+1, the reverse will occur: the line $D_j$ will deliver the turn-off voltage Vb and the data line $D_j'$ will deliver the video voltage Vv. It is then the driving transistor T2' that will deliver the current to the OLED diode, whereas the transistor T2 will be in the recovery phase.

An example of corresponding addressing sequence is illustrated schematically in FIG. 5, which demonstrates the dual behaviour of the transistors T2 and T2': when one is in the display phase, the other is in the recovery phase and vice versa.

It has been seen that the turn-off voltage Vb applied to a pixel is a pre-determined fixed voltage or, advantageously, a voltage that is variable from one pixel to another, being a function of the video voltage applied to the pixel.

A column driver normally used in liquid crystal displays (LCDs) may advantageously be used as column driver for controlling the 2n data lines of a display screen according to the embodiment in FIG. 3. Indeed, these drivers are designed to supply a voltage, referred to as mirror voltage, that is a function of the applied video voltage. More precisely, they usually deliver at the output, for a given row of pixels, the video voltage to be applied to each data line $D_j$ of the matrix, which is a function of the video signal DATA VIDEO received at the input, or a corresponding mirror voltage. It is recalled that the picture dot of an LCD screen is a liquid crystal cell with one pixel electrode, to which the video voltage is applied, and a counter-electrode common to all the pixels, to which a reference voltage is applied. The mirror voltage of a given video voltage is such that the direction of the electric field across the terminals of the pixel is reversed, but allows the same luminance to be obtained (the same grey level). The column drivers of LCD screens thus usually deliver at the output, for each data line of the matrix, one or the other voltage, according to the frame (reversed frame mode), and/or according to the pixel column (reversed column mode), concerned. In a reversed column mode, the following operation will thus occur: on one frame, the video voltage is applied to the data lines $D_j$, $D_{j+2}$, $D_{j+4}$; and the mirror voltage to the data lines $D_{j+1}$, $D_{j+3}$, $D_{j+5}$. On the following frame, the reverse occurs: the mirror voltage is applied to the data lines $D_j$, $D_{j+2}$, $D_{j+4}$; and the video voltage is applied to the data lines $D_{j+1}$, $D_{j+3}$, $D_{j+5}$ and so on. In a known manner, this prevents the phenomenon known as 'marking' from occurring, by alternating the direction of the electric field on the pixels, and allows the power consumption to be reduced.

The mirror voltage is defined with respect to the counter-electrode voltage in order to obtain the same transmission coefficient on the pixel as with the video voltage. Generally speaking, the video voltage is taken to be positive and the mirror voltage to be negative.

Thus, the mirror voltage has an amplitude that is the corresponding inverse of the video voltage: this definition applies very well to the notion of variable turn-off voltage that is a function of the video voltage: a stress in voltage, of inverse amplitude, is applied that is negative with respect to the voltage stress caused by the video voltage that drives the current conduction. The value of this inverse amplitude is, in practice, determined by measurement, in such a manner as to compensate, in an optimal manner, for the stress caused by the video voltage.

The turn-off voltage to be applied in order to compensate for a video voltage of given amplitude may be determined by suitable measurements. A correspondence table, applicable to a given display screen, can thus be defined. It will then suffice to use appropriate values of resistors in the potential divider circuit that normally delivers the corresponding video voltage and mirror voltage levels.

Such an LCD screen column driver can thus be used to control the data lines of a display screen such as is illustrated in FIG. 3: it suffices to output, for each pixel column j, the two outputs video voltage $Sv_j$ and mirror voltage $Sm_j$, and for these two outputs to be connected, the first to the data line $D_j$ and the second to the data line $D_j'$, and to control this column driver in reversed column mode (FIG. 4): on one frame k the column driver applies the video voltage to the data lines $D_j$ and the mirror voltage, i.e. the turn-off voltage, to the data lines $D_j'$; on the following frame, the reverse occurs: the column driver applies the mirror voltage, i.e. turn-off voltage, to the data lines $D_j$, and the video voltage to the data lines $D_j'$, and so on, for example from frame to frame.

Figure 6:
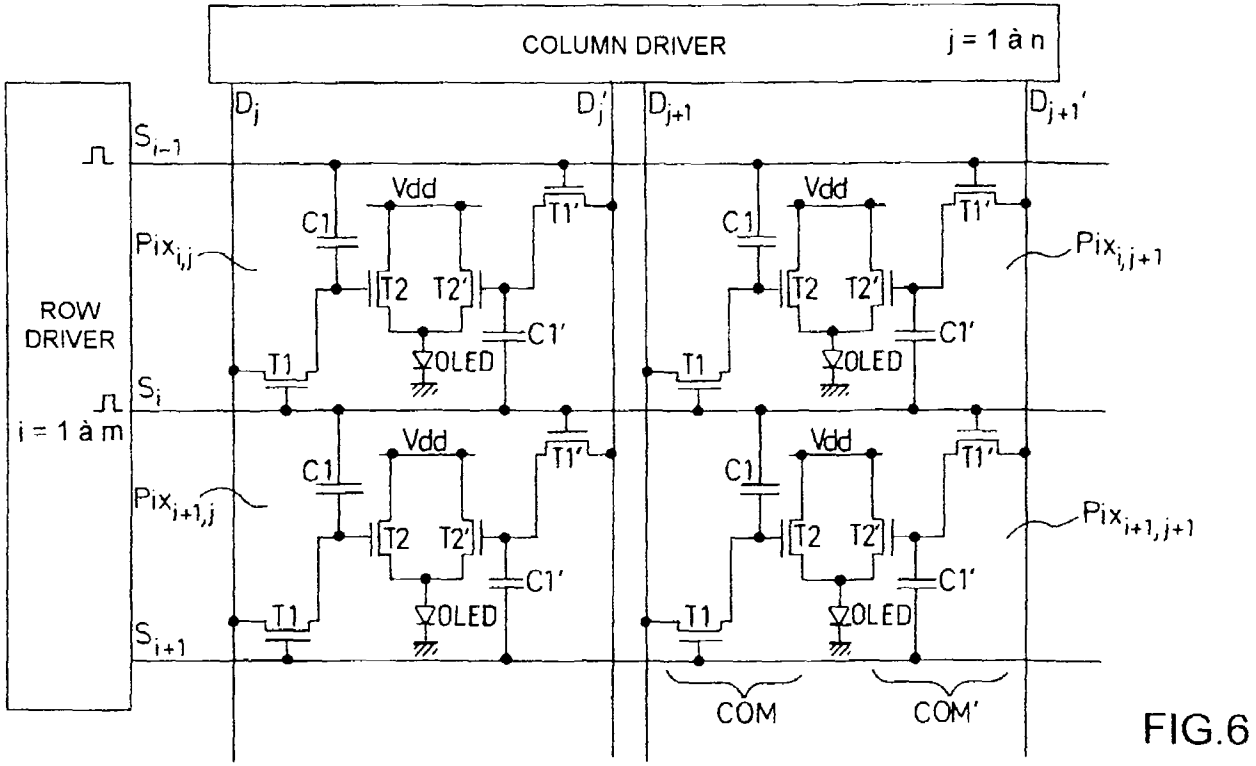
FIG. 6 illustrates an OLED diode picture element structure according to another embodiment of the invention.

FIG. 6 illustrates another embodiment of the invention. As in the embodiment illustrated in FIG. 3, the display screen comprises n.m pixels $Pix_{i,j}$, i=1 to m; j=1 to n. It comprises m select lines $S_i$, each line allowing n pixels of the display screen to be addressed. It comprises 2.n data lines $D_j$ and $D_j'$, which allow a video voltage and a turn-off voltage to be applied to each of the n pixels of a select line. It differs from the previous embodiment, seen in relation to FIG. 3, in that the control of the two driver circuits corn and com' uses, at the same time, two select lines of the display screen $S_i$ and $S_{i-1}$, and two data lines $D_j$ and $D_j'$.

This embodiment corresponds to an addressing mode for the matrix known as 'inverted vertical scanning': during one frame, the select lines are sequentially addressed from top to bottom, and in the following frame they are sequentially addressed from bottom to top.

Looking in more detail, in this embodiment of the invention, to each picture element $Pix_{i,j}$ are made to correspond the select line $S_i$ to which the gate of the switching transistor of one of the driver circuits is connected, and another select line of the matrix, preferably the preceding select line $S_{i-1}$, to which the gate of the switching transistor of the other driver circuit is connected. To each pixel $Pix_{i,j}$, a first data line $D_j$ and a second data line $D_j'$ are also made to correspond. The first data line $D_j$ is connected to the switching transistor of one of the driver circuits, and the second data line $D_j'$ is connected to the switching transistor of the other driver circuit. Thus, in the example, the gate of the switching transistor T1 of the circuit COM is connected to $S_i$, the gate of the switching transistor T1' of the circuit COM' is connected to $S_{i-1}$; $D_j$ is connected to the switching transistor T1 of the circuit COM and $D_j'$ is connected to the switching transistor T1' of the circuit COM'.

The example illustrates a connection variant of the holding capacitor of the driver circuits COM and COM': the holding capacitor of one of the driver circuits is connected to the select line that controls the gate of the switching transistor of the other driver circuit. Thus, the holding capacitor C1 of the driver circuit COM is connected to the select line $S_{i-1}$, which is connected to the gate of the transistor T1' of the driver circuit COM'. The holding capacitor C1' of the driver circuit COM' is connected to the select line $S_i$ which is connected to the gate of the transistor T1 of the driver circuit COM. As previously, the capacitors C1 and C1' could be connected to the reference voltage Vdd.

The mode of operation will then be as follows:

During one video frame, the frame k for example, the select lines are scanned in sequence from top to bottom, in other words in the direction of increasing indices i from 1 to m (FIG. 1). In this case and as indicated in FIG. 7, the data lines $D_j$ are controlled in order to transmit the video voltages and the data lines $D_j'$ are controlled in order to transmit the turn-off voltages.

When the select line $S_{i-1}$ is addressed, by applying a voltage level Vgon during a corresponding row time, the switching transistor T1' of the circuit COM' is conducting. It switches the turn-off voltage present at that time on the column $D_j'$ onto the gate of the transistor T2': the transistor T2' enters the recovery phase.

When the select line $S_i$ is addressed at the following row time, by applying during the corresponding row time, the voltage level Vgon, the switching transistor T1 of the circuit COM is conducting. It switches the video voltage present at that time on the column $D_j$ onto the gate of the transistor T2: the transistor T2 enters the display phase, and delivers the current to the OLED diode.

Figures 7, 8A:
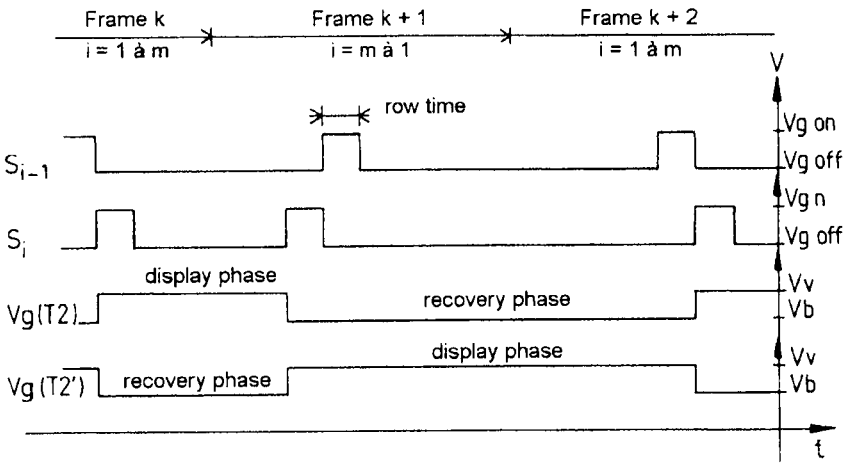

During the following frame k+1, the select lines are scanned in sequence in the reverse order, in other words from the bottom to the top or, alternatively, in the order of decreasing indices i from m to 1 (FIG. 1) and the role of the data lines $D_j$ and $D_j'$ is reversed: the lines $D_j$ transmit the turn-off voltages and the lines $D_j'$ transmit the video voltages (FIG. 7). When the select line $S_i$ is addressed, by applying for a corresponding row time a voltage level Vgon, the switching transistor T1 of the circuit COM is conducting. It switches the turn-off voltage present on the data line $D_j$, onto the gate of the transistor T2 and the associated holding capacitor C1. The transistor T2 is in the recovery phase.

When the select line $S_{i-1}$, is then addressed, by applying for a corresponding row time a voltage level Vgon, the switching transistor T1' of the circuit COM' is conducting. It switches the video voltage present on the data line $D_j'$, onto the gate of the transistor T2' and the associated holding capacitor C1'. During this frame k+1, it is the transistor T2' that is in the display phase and the transistor T2 that is in the recovery phase.

A corresponding addressing sequence is illustrated in FIG. 8*a*. It demonstrates that the respective durations of display phase and recovery phase are not equal for the two transistors T2 and T2' of a pixel, owing to the alternation of the vertical scanning. In the example illustrated, the recovery phase of the transistor T2 is longer than its display phase. For the transistor T2', the reverse is true. In practice, the durations of the display and recovery phases of the transistors T2 and T2' of a pixel $Pix_{i,j}$ depend on the rank i of the corresponding select line $S_i$. In practice, a delay time is included between the end of the scanning of the lines of one frame and the start of the scanning of the lines of the following frame.

In order to converge towards close, or even equal, durations between top-bottom and bottom-top scanning:

- the matrix can be addressed rapidly then a delay time be left before the following scan;
- scanning X times always in the same direction can be effected before switching to a scan of X times in the other direction. The table in FIG. 8*b* is an illustration that with such an alternation of the scanning every X=2 frames, the recovery and video times between COM and COM' can be balanced. In this Figure, Vv(k) and Vb(k) represent the video and turn-off voltages switched onto the gates of the transistors T2 and T2' of the pixels for the select line in question applied during the frame k. As long as the select line in question has not been selected, the voltage levels of the gates of the transistors T2 and T2' are those applied on the preceding frame k−1. In the table, the variation of the voltage levels over the frame time, and for four successive frames, is shown for a line at the top of the display screen, in the example $S_1$, from the middle of the display screen ($S_{m/2}$) and from the bottom of the display screen ($S_m$).

The turn-off voltage may be fixed or a function of the video voltage. In the latter case, and as in the embodiment seen in relation to FIG. 3, a column driver from the prior art of LCD screens may advantageously be employed for addressing the data lines of a display screen according to FIG. 6. The driver will then be used to control the data lines $D_j$, $D_j'$ as described in the previous embodiment, with in addition the reversing of the presentation of the video data in the direction of scanning of the select lines $S_i$. For example, in one frame, the column driver applies the video voltage to the data lines $D_j$, and the mirror, or turn-off, voltage to the data lines $D_j'$, in the successive order of the lines $S_i$ scanned from top to bottom. In the following frame, the reverse occurs: the column driver applies the mirror, or turn-off, voltage to the data lines $D_j'$, and the video voltage to the data lines $D_j$, in the successive order of the lines $S_i$ scanned from bottom to top, and so on from frame to frame.

It will be noted that the embodiment in FIG. 6, in which the holding capacitors are connected between the gate of a driving transistor and a select line, combined with the progressive alternation of the scanning of the select lines, allows undesirable coupling phenomena via C1 or C1' to be prevented.

In the embodiments in FIGS. 3 and 6, the driver circuits COM and COM' are identical to the circuit of the prior art (FIG. 1), the alternating control of their driving transistors T2 and T2' being obtained by the select and data lines that control their switching transistors T1 and T1', by doubling the number of data lines to be controlled.

Figure 9:
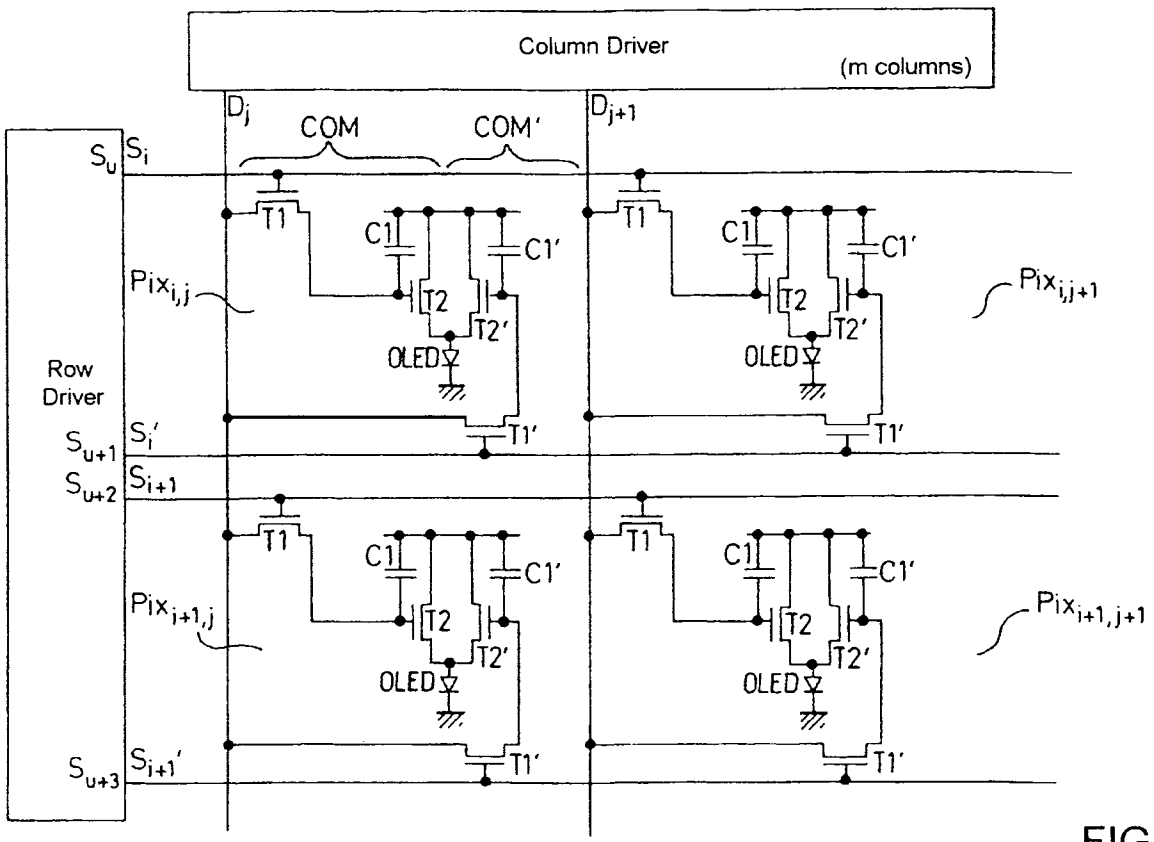
FIG. 9 illustrates an OLED diode picture element structure according to another embodiment of the invention.

In one variant illustrated in FIGS. 9 and 10, instead of using the data lines in order to allow the alternation of the display and recovery functions of the driver circuits COM and COM', the select lines are used: instead of doubling the number of data lines, the number of select lines is doubled.

As illustrated in FIG. 9, there are then 2.m select lines, two per pixel, and n data lines associated with the n.m pixels $Pix_{i,j}$ of the display screen, and the matrix is addressed in a row-swap mode: the video voltage is applied to the even rows and the turn-off voltage is applied to the odd rows (recovery phase) and everything is swapped in the following frame.

One advantage of transferring to the row driver the control of the alternation of the display and recovery functions of the driver circuits COM and COM' resides in the fact that the row drivers are less costly than the column drivers in terms of complexity and space. Moreover, these drivers can be easily integrated onto glass, and notably in amorphous silicon technology.

In this embodiment, the gate of the switching transistor of a driver circuit is connected to the select line of the pixel $Pix_{i,j}$, and the gate of the switching transistor of the other driver circuit is connected to another select line that is denoted $S_i'$. The lines $S_i$ and $S_i'$ are two successive rows of the row driver $S_u$ and $S_{u+1}$, with u=1 to 2m, and i=1 to n.

The addressing of the matrix can be related to an addressing of the row-swap type for the LCD with the select lines $S_i$ addressing the video and the lines $S_i'$ addressing the recovery and vice versa in the following frame.

A corresponding addressing mode for the matrix is illustrated in the table in FIG. 10, which demonstrates the dual behaviour of the transistors T2 and T2', in relation to FIG. 9.

The pixel $Pix_{i,j}$ is now considered.

During a frame k, when the row $S_u=S_i$ is addressed, the transistor T1 is conducting and switches the video voltage Vv present at this time on the data line $D_j$ onto the gate of the transistor T2 and the capacitor C1.

When the row $S_{u+1}=S_i'$ is addressed, the transistor T1' is conducting and switches the video voltage Vb present at this time on the data line $D_j$ onto the gate of the transistor T2' and the capacitor C1'.

With regard to the control of the column driver, the video/recovery alternation for the driver circuits of a given pixel is performed on the same column: there is a time for displaying the video voltage and a time for applying the recovery voltage. Since the number of rows has doubled (u=2.m), the row time is divided by 2.

The turn-off voltage can be the video voltage, inverse of the video that was applied in the preceding frame (column driver output) or else a pre-determined reset voltage. This reset voltage can then for example be applied to the columns by multiplexing, by using an integrated column driver circuit design with 3 TFT transistors, such as that described in the application EP0815552: either the driver output is applied to the columns or the reset voltage.

Figure 11:
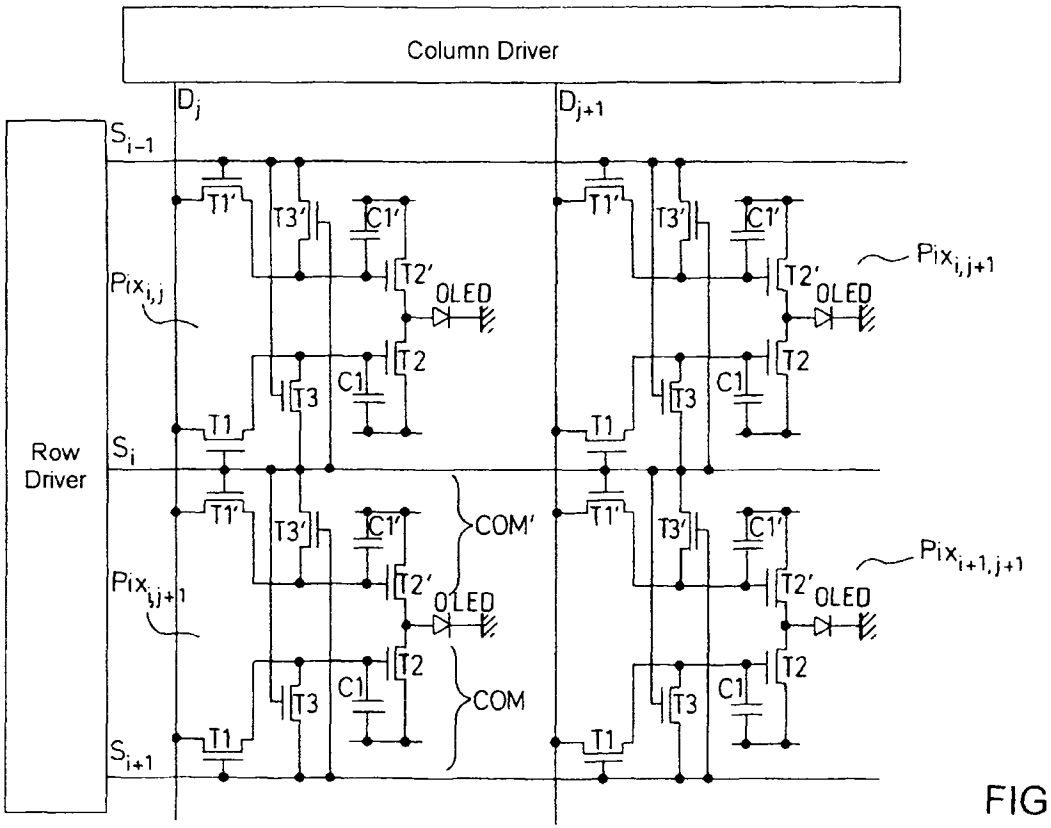
FIG. 11 illustrates an OLED diode picture element structure according to another embodiment of the invention.

Another embodiment of the invention is illustrated in FIG. 11. This embodiment has the advantage, with respect to the two embodiments previously described, of using only the usual select and data lines of the display screen. For a display screen of n.m pixels, there are therefore m select lines $S_i$ and n data lines $D_j$ as in the prior art (FIG. 1). In other words, it does not require the data lines to be doubled, in contrast to the embodiments illustrated in FIGS. 3, 6 and 9. This is a valuable advantage in terms of circuit topology (line crossing, control of the lines) and space occupied.

This is obtained by providing in the driver circuit an additional switching transistor by which the alternating control of the driving transistors will be provided. This additional transistor of the driver circuit is denoted T3 for the circuit COM and T3' for the circuit COM'.

Looking in more detail, in this embodiment of the invention, to each picture element $Pix_{i,j}$ are made to correspond a single data line $D_j$ that is connected to the switching transistors T1 and T1' of the two driver circuits COM and COM', a first select line $S_i$ to which the gate of the switching transistor of one of the driver circuits is connected, and another select line of the matrix, preferably the preceding line $S_{i-1}$, to which the gate of the switching transistor of the other driver circuit is connected. In the example, $S_i$ is connected to the gate of the switching transistor T1 of the circuit COM, and $S_{i-1}$ is connected to the gate of the switching transistor T1' of the circuit COM'. The elements T1, C1 and T2 of the circuit COM and T1', C1' and T2' of the circuit COM' are connected together and to the diode, as before (FIGS. 1, 3, 6).

The additional switching transistor provided in each driver circuit is connected between the gate of the driving transistor and the gate of the switching transistor. The gate of this additional transistor is connected to the select line associated with the other driver circuit. Thus, in the example illustrated, the driver circuit COM comprises an additional transistor T3, connected between the gate of the switching transistor T1 and the gate of the driving transistor T2. This additional transistor has its gate connected to the select line $S_{i-1}$. In a similar manner, the driver circuit COM' comprises an additional transistor T3', connected between the gate of the switching transistor T1' and the gate of the driving transistor T2'. This additional transistor has its gate connected to the select line $S_i$.

In the figure, the holding capacitor in each driver circuit is connected to the reference voltage VDD. The holding capacitor could also just as well be connected as in FIG. 6.

The switching transistors T3 and T3' in each driver circuit allow the alternate turning off of the driving transistors to be obtained, by switching of the voltage level Vgoff of the unaddressed select lines. Indeed, each select line is forced to a level Vgoff, whenever it is not addressed. This level Vgoff is such that the switching transistor is turned off. When it is addressed, it has a voltage level Vgon applied to it for a row time, in such a manner that the switching transistors connected to this line go to the "on" state and switch the voltage present on the data line onto the gate of the driving transistor. In the example illustrated, the transistors T1, T2, T3, T1', T2', T3' are all of the same type, n-type in the example, in order to be switched to the on state by a level Vgon on their gate and to the off state by a level Vgoff on their gate.

Figure 12:
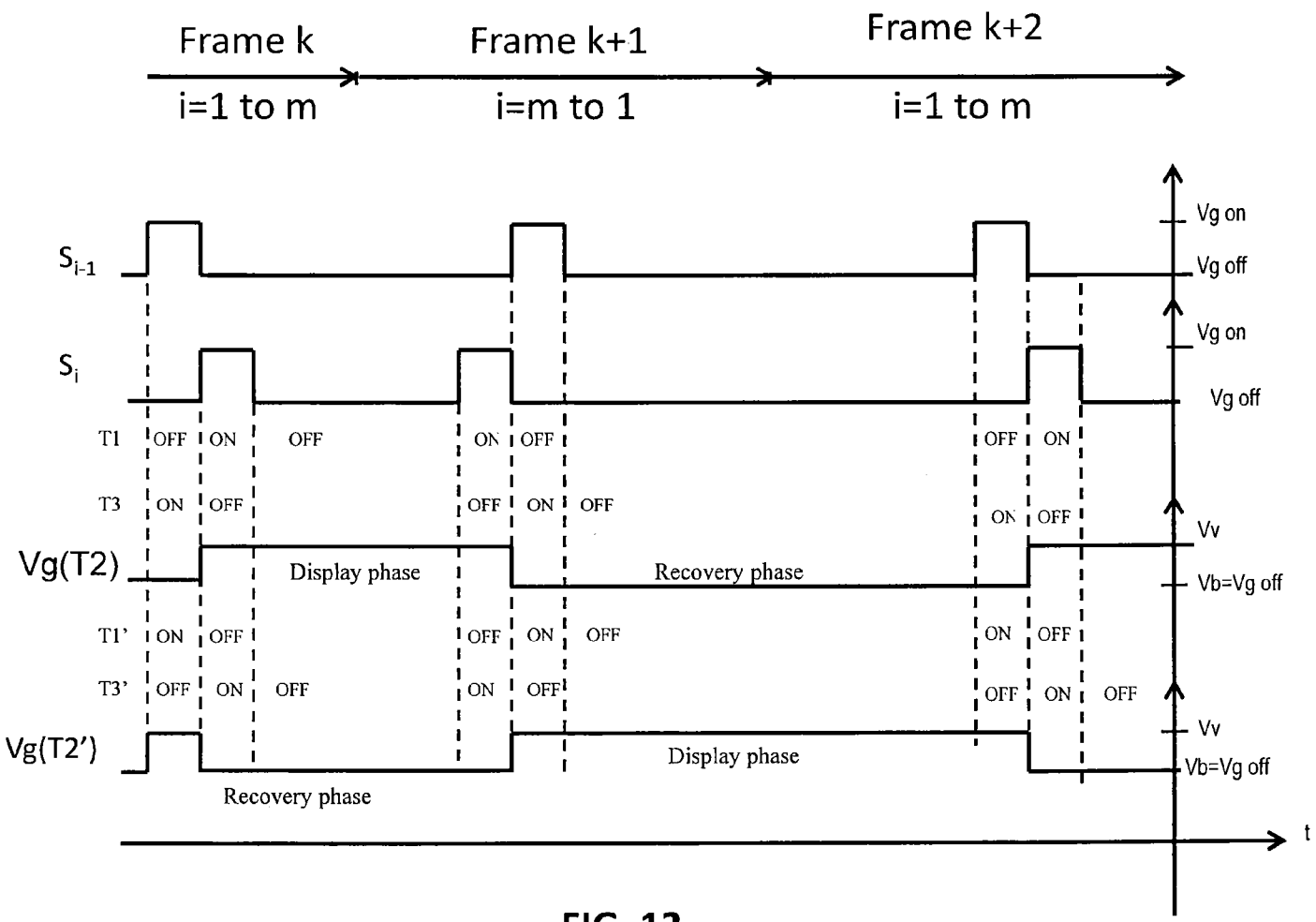
FIG. 12 illustrates a corresponding addressing sequence.

One example of corresponding addressing sequence is illustrated schematically in FIG. 12, which demonstrates the dual behaviour of the transistors T2 and T2'.

This embodiment uses a reversed vertical scanning addressing mode in order to provide the dual control, in an alternating fashion, of the two driven circuits.

In this embodiment, the level Vgoff is therefore used as turn-off voltage for the driving transistors, which is switched in a suitable manner by the additional transistors T3.

The operation is then as follows:

During the frame k, the display screen is scanned from top to bottom.

When the select line $S_{i-1}$, is addressed, the transistors T1' and T3 are switched to the "on" state for the corresponding row time. The select line $S_i$ is not addressed at this time, and is at the level Vgoff. The transistors T1 and T3' are in the "off" state.

The transistor T1' switches the video voltage present at this time on the data line $D_j$ onto the gate of the driving transistor T2': the transistor T2' delivers the current needed for driving the diode. The transistor T3 switches the level Vgoff present on the line $S_i$ onto the gate of the driving transistor T2, which turns this transistor T2 off, putting it into recovery phase.

Then, the select line $S_{i-1}$ is deselected, brought back to the voltage level Vgoff and the select line $S_i$ is addressed, with the voltage level Vgon being applied to it for the corresponding row time. The transistors T1 and T3' are switched to the conducting or "on" state. The transistors T1' and T3 go to the "off" state. The transistor T1 switches the video voltage present at that time on the data line $D_j$ onto the gate of the driving transistor T2. The transistor T3' switches the voltage level Vgoff present at that time on the select line $S_{i-1}$ onto the gate of the switching transistor T2', which is then turned off and put into the recovery phase.

Thus, the transistor T2, after having been turned off and in recovery phase during the preceding row time (addressing of the select line $S_{i-1}$), supplies the current corresponding to the applied video voltage to the OLED diode for the whole of the rest of the frame.

During the following frame k+1, the scan order of the display screen is reversed, the line $S_i$ thus being addressed before the line $S_{i-1}$. The roles of the various transistors of the pixel $Pix_{i,j}$ are reversed.

When the select line $S_i$ is addressed, the transistors T1 and T3' are conducting or "on". At this time, the select line $S_{i-1}$, which is not addressed, is at a voltage level Vgoff. The transistors T1' and T3 are therefore turned off. The transistor T1 switches the video voltage present at that time on the data line $D_j$ onto the gate of the driving transistor T2. The transistor T2 supplies the current to the OLED diode. The transistor T3' switches the level Vgoff onto the gate of the driving transistor T2', turning this transistor off, into the recovery phase.

When the select line $S_{i-1}$, is subsequently addressed, the transistors T1' and T3 are turned on. The select line $S_i$, which is no longer addressed, is at a level Vgoff. The transistors T1 and T3' are turned off.

The transistor T1' switches the video voltage present at that time on the data line $D_j$ onto the gate of the driving transistor T2', which turns on and drives the current into the OLED diode. The transistor T3 switches the level Vgoff onto the gate of the transistor T2, which turns this transistor off, into the recovery phase.

Thus, the transistor T2' after having been turned off and in recovery phase during the preceding row time (addressing of the select line $S_i$), then supplies the current corresponding to the applied video voltage to the OLED diode for the whole of the rest of the frame. While the transistor T2' is turned off, it is the transistor T2 that supplies the current to the OLED diode.

Variant embodiments may be envisaged. For example, the gate and the drain of the additional transistors T3 and T3' can be connected to the select lines according to different arrangements. The important thing is to obtain the switch command for Vgoff at the right moment. Considering the pixels of the select line $S_i$, the gate of the transistors T3 can, for example, be connected to the preceding select line $S_{i-1}$ and the drain to the present select line $S_i$, and the gate of the transistors T3' to the following select line $S_{i+1}$ and the drain to the select line $S_i$.

As in the embodiment explained in relation to FIG. 6, the durations of the display and recovery phases are not equal for the two transistors T2 and T2'. These durations can be made to converge by applying the same principles explained on page 12, line 26 and following lines.

In the embodiments that have just been described by way of examples of the implementation of the invention, or in variants of these embodiments that follow from them, and in particular in the embodiments seen in relation to FIGS. 3, 4 and 6, the column drivers normally used in liquid crystal display screens (LCDS) will be advantageously employed, which drivers thus advantageously deliver a variable turn-off voltage, being a function of the video voltage, and whose various addressing modes (row-swap, column-reversing, dot reversing, frame reversing) allow the diode to be driven with a duty cycle of 100%, while at the same time providing the alternation of the display and recovery phases on the driving transistors.

Those skilled in the art know how to use these various addressing modes in the appropriate manner with an organic light-emitting display screen according to the invention, by using the mirror voltage outputs of the driver as turn-off voltage outputs for the driving transistors, so as to achieve the operation sought, with the video voltage/turn-off voltage alternation on each of the various driving transistors of the display screen. The turn-off voltage is then a function of the applied video voltage.

The invention just described is especially applicable to organic light-emitting display screens that use an active matrix with TFT transistors (amorphous silicon). It is more generally applicable to active matrix organic light-emitting display screens.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by the definition contained in the appended claims and equivalents thereof.

The invention claimed is:

1. An organic light-emitting display screen, comprising:

n×m picture dots organized in a matrix with m rows and n columns, m and n being integers greater than or equal to 1;

a circuit for addressing the n×m picture dots, including m row select lines, the picture dots of a given row being connected to a respective row select line among said m row select lines for selection of said given row and to another row select line among said m row select lines, said another row select line configured for selection of another row of picture dots;

n data lines, one for each of the n columns of picture dots, to apply a video voltage to a picture dot of a respective column and a currently selected row; and each picture dot including an organic electroluminescent (OLED) diode and first and second driver circuits for the OLED, each of the first and second driver circuits including:

a driving transistor connected between a reference voltage and one electrode of the OLED, a switching transistor for connecting data line of the respective column to a gate of the driving transistor, an additional transistor for applying a turn-off voltage onto the gate of the driving transistor, and a capacitor connected to the gate of the driving transistor and the reference voltage, to maintain a gate voltage, wherein said respective row select line for the picture dot is connected to a gate of the switching transistor of the first driver circuit and to a gate of the additional transistor of the second driver circuit, said another row select line for the picture dot is connected to a gate of the switching transistor of the second driver circuit and to a gate of the additional transistor of the first driver circuit, and the circuit for addressing each of the n×m picture dots sequentially selects each of successive row select lines from top to bottom of the matrix during one frame and from bottom to top during a next frame such that only one row select line is selected at any given time, during a first frame said respective row select line is selected before said another row select line is subsequently selected, wherein during the first frame the driving transistor of the first driver circuit is put into a display phase when said respective row select line is selected and before said another row select line is subsequently selected and is put into a recovery phase when said another row select line is selected, and the driving transistor of the second driver circuit is put into the recovery phase when said respective row select line is selected and before said another row select line is subsequently selected and is put into the display phase when said another row select line is selected, and during a second frame subsequent to the first frame, said another row select line is selected before said respective row select line is subsequently selected, wherein during the second frame the driving transistor of the first driver circuit is put into the recovery phase when said another row select line is selected and before said respective row select line is subsequently selected and is put into the display phase when said respective row select line is selected, and the driving transistor of the second driver circuit is put into the display phase when said another row select line is selected and before said respective row select line is subsequently selected and is put into the recovery phase when said respective row select line is selected.

2. The display screen according to claim 1, wherein the additional transistor is connected between the gate of the driving transistor and a select line connected to the gate of the switching transistor in each of the first and second driver circuits, one of the first driver circuit and the second driver circuit is controlled on the gate of the additional transistor by the select line connected to the gate of the switching transistor of another one of the first driver circuit and the second driver circuit, and an order of a sequential selection of the successive row select lines of the display screen is alternately reversed at each frame.

3. The display screen according to claim 1, wherein the circuit for addressing comprises a row driver and a column driver used in liquid crystal displays for controlling the m row select lines and the n data lines.

4. The display screen according to claim 2, wherein each column of the n×m picture dots includes one of the n data lines.

5. The display screen according to claim 1, wherein said given row of picture dots and said another row of pictures dots are adjacent.

6. The display screen according to claim 1, wherein when the driving transistor of the second driver circuit is put into the display phase, the gate of driving transistor of the second driver circuit is supplied with an ON voltage, and wherein when the driving transistor of the second driver circuit is put into the recovery phase, the gate of driving transistor of the second driver circuit is supplied with an OFF voltage.

7. The display screen according to claim 6, wherein the OFF voltage is a predetermined fixed voltage.

8. The display screen according to claim 6, wherein the OFF voltage is a voltage that is variable from one pixel to another and is a function of the video voltage applied to the picture dot.

9. The display screen according to claim 1, wherein during the first frame when said respective row select line is selected and before said another row select line is subsequently selected, the switching transistor of the second driver circuit and the additional transistor of the second driver circuit are put in OFF and ON states, respectively, and the switching transistor of the first driver circuit and the additional transistor of the first driver circuit are put in ON and OFF states, respectively, and when said another row select line is subsequently selected, the switching transistor of the second driver circuit and the additional transistor of the second driver circuit are put in ON and OFF states, respectively, and the switching transistor of the first driver circuit and the additional transistor of the first driver circuit are put in OFF and ON states, respectively, during the second frame when said another row select line is selected and before said respective row select line is subsequently selected, the switching transistor of the second driver circuit and the additional transistor of the second driver circuit are put in ON and OFF states, respectively, and the switching transistor of the first driver circuit and the additional transistor of the first driver circuit are put in OFF and ON states, respectively, and when said respective row select line is subsequently selected, the switching transistor of the second driver circuit and the additional transistor of the second driver circuit are put in OFF and ON states, respectively, and the switching transistor of the first driver circuit and the additional transistor of the first driver circuit are put in ON and OFF states, respectively.

* * * * *